US005293810A

United States Patent [19]

Kimura et al.

[11] Patent Number: 5,293,810

[45] Date of Patent: * Mar. 15, 1994

[54] VARIABLE DISPLACEMENT COMPRESSOR

[75] Inventors: Kazuya Kimura; Hiroaki Kayukawa, both of Kariya, Japan

[73] Assignee: Kabushiki Kaisha Toyoda Jidoshokki Seisakusho, Kariya, Japan

[ * ] Notice: The portion of the term of this patent subsequent to Jan. 26, 2010 has been disclaimed.

[21] Appl. No.: 939,116

[22] Filed: Sep. 2, 1992

Related U.S. Application Data

[63] Continuation-in-part of Ser. No. 780,140, Oct. 21, 1991.

[30] Foreign Application Priority Data

Sep. 20, 1991 [JP] Japan ..... 3-241998

[51] Int. Cl.[5] ..... F01B 3/02

[52] U.S. Cl. ..... 92/12.2; 92/71; 91/505

[58] Field of Search ..... 74/60; 91/505, 506, 91/507; 92/12, 2, 57, 70, 71

[56] References Cited

U.S. PATENT DOCUMENTS 3,535,984 10/1970 Anderson ..... 91/506
4,513,630 4/1985 Pere et al. ..... 92/12.2
4,815,358 3/1989 Smith ..... 92/71
5,181,453 1/1993 Kayukawa et al. ..... 92/12.2

FOREIGN PATENT DOCUMENTS 60-175783 9/1985 Japan .
61-149585 7/1986 Japan .

*Primary Examiner*—Edward K. Look
*Assistant Examiner*—F. Daniel Lopez
*Attorney, Agent, or Firm*—Brooks Haidt Haffner & Delahunty

[57] ABSTRACT

A variable displacement compressor comprises a housing containing a cylinder block, a plurality of pistons disposed in the cylinder block, a crank chamber, a rotatable drive shaft, a drive plate mounted on the drive shaft such that it may rotate integrally with the drive shaft, a rotary journal which can be pivoted with respect to the drive plate and a swash plate, supported on the rotary journal, for causing the pistons to compress a fluid. The inclination angle of the swash plate is controlled in relation to the internal pressure in each cylinder, and to the pressure in the crank chamber. The compressor further has a pin mechanism, pivotally mounted on the drive plate, for coupling the drive plate and the rotary journal. The pin mechanism is adapted to slide with respect to the rotary journal and to pivot with respect to the drive plate, when the rotary journal pivots with respect to the drive plate.

18 Claims, 5 Drawing Sheets

VARIABLE DISPLACEMENT COMPRESSOR

This is a continuation-in-part of co-pending U.S. application Ser. No. 07/780,140 filed on Oct. 21, 1991, which is incorporated herein by reference.

This application also claims the priority of Japanese Patent Application No. 3-241998 filed on Sep. 20, 1991, which is incorporated herein by reference.

BACKGROUND OF THE INVENTION

1. Field of the Invention

The present invention relates generally to variable displacement swash plate type compressors. More particularly, the invention relates to an improved mechanism for coupling a rotary journal in a variable displacement compressor with a drive plate which rotates integrally with a drive shaft.

2. Description of the Background Art

Variable displacement compressors have a wide variety of applications including the use as compressors for air conditioning, and refrigeration systems such as automotive air conditioners. Japanese Unexamined Utility Model Publication No. 62-183082 discloses a conventional variable displacement swash plate type compressor, which is illustrated in FIG. 6.

In this compressor, a rotary journal 103 is coupled, via a link pin 102, with a drive plate 101, securely mounted to a piston 106 that is connected to the swash plate 104 by a connecting rod 107. The rotational motion of the rotary journal 103 causes undulating movement of the swash plate 104, which in turn drives the connecting rods and pistons one after another in a linear reciprocating manner.

An arc-shaped elongated hole 109 is formed in a support arm 108, and protrudes from the drive plate 101. The elongated hole 109 serves as a guide for slidably holding the link pin 102. This arrangement keeps the top clearance of the piston 106 located at the top dead center position approximately constant, regardless of the inclination angle of the journal 103, and that of the swash plate 104.

When the dimensional accuracy of the arc-shaped, elongated hole 109 is low, however, the top clearance of the piston 106 cannot be maintained constant. Meanwhile, when the gap between the elongated hole 109 and the link pin 102 is great, noise is generated. It is difficult to further improve the dimensional accuracy of the elongated hole 109, with all the machining techniques currently available.

The discharge pressure of the compressor is generally higher than the internal pressure of the crank case. Therefore, when a certain piston is in its top dead position, the pressure of the gas in each compression chamber, that is exerted on the face of the piston head, will typically be higher than the pressure of the crank case gas acting on the rear side of the piston head. This creates a compressive stress which acts on the swash plate 104 at the point of action Mf.

In this design, the point of support Mk where the link pin 102 contacts the elongated hole 109 in the drive plate 101, will shift depending on the inclination angle of the swash plate 104. Especially in the type of compressor shown in FIG. 6, the line segment drawn between the point of action Mf and the point of support Mk is designed to be parallel with the drive shaft 100, when the inclination angle of the swash plate 104 is the greatest (when the discharge volume in the compressor is maximum). Accordingly, as the inclination angle of the swash plate 104 decreases with the change in the internal pressure of the crank case, the point of support Mk of the compressive stress shifts downward along the elongated hole 109. At the same time, the point of action Mf on the swash plate 104 receiving the compressive stress of the piston 106 located at the top position, shifts upward relative to the point of support Mk, so that the line segment drawn between the point of action Mf and the point of support Mk no longer maintains the parallel relationship with the drive shaft 100.

Thus, the compressive stress produces a moment that acts to further reduce the inclination angle of the swash plate 104. This moment makes it difficult to smoothly control the discharge volume of the compressor. In other words, although this moment promotes inclination of the swash plate 104 in the direction of decreasing discharge volume, it inhibits the inclination of the swash plate 104 in the direction of increasing the discharge volume. Therefore, such conventional compressor has two characteristics. The first is that compressor is sensitive to decrease in the discharge volume, and the second being that it is not sensitive to increase in the discharge volume. Such characteristics are not preferred in the variable displacement compressor.

SUMMARY OF THE INVENTION

Accordingly, it is a primary objective of the present invention to provide a variable displacement compressor which can keep the top clearance of each piston substantially constant without making significant noise, and which has ideal discharge capacity controllability.

To achieve the foregoing and other objects in accordance with the purpose of the present invention, an improved variable displacement compressor is provided. The compressor includes a housing containing a cylinder block having a plurality of cylinders, a plurality of pistons disposed to the respective cylinders, a drive shaft rotatably mounted in the housing, a drive plate mounted on the drive shaft so that it may rotate integrally with the drive shaft, a rotary journal pivotally coupled to the drive plate so that it may rotate synchronously with the drive plate, and a swash plate supported on the rotary journal, for driving the pistons and for compressing a fluid.

The undulating movement of the swash plate causes the pistons to perform reciprocal motions. The inclination angle of the swash plate which determines the piston stroke, is controlled based on the internal pressure of the cylinders and the pressure in the crank chamber in the housing. The compressor according to the present invention is further equipped with a pin mechanism pivotally mounted on the drive plate so as to couple the drive plate and the rotary journal. The pin mechanism is adapted to be able to slide with respect to the rotary journal, and to pivot with respect to the drive plate, when the rotary journal pivots with respect to the drive plate.

BRIEF DESCRIPTION OF THE DRAWINGS

The features of the present invention that are believed to be novel are set forth with particularity in the appended claims. The invention together with the objects and advantages thereof may best be understood by reference to the following description of the presently preferred embodiments taken in conjunction with the accompanying drawings in which:

DESCRIPTION OF THE PREFERRED EMBODIMENTS

The preferred embodiment of the present invention will now be described in greater detail, with reference to FIGS. 1 to 4.

Figure 1:
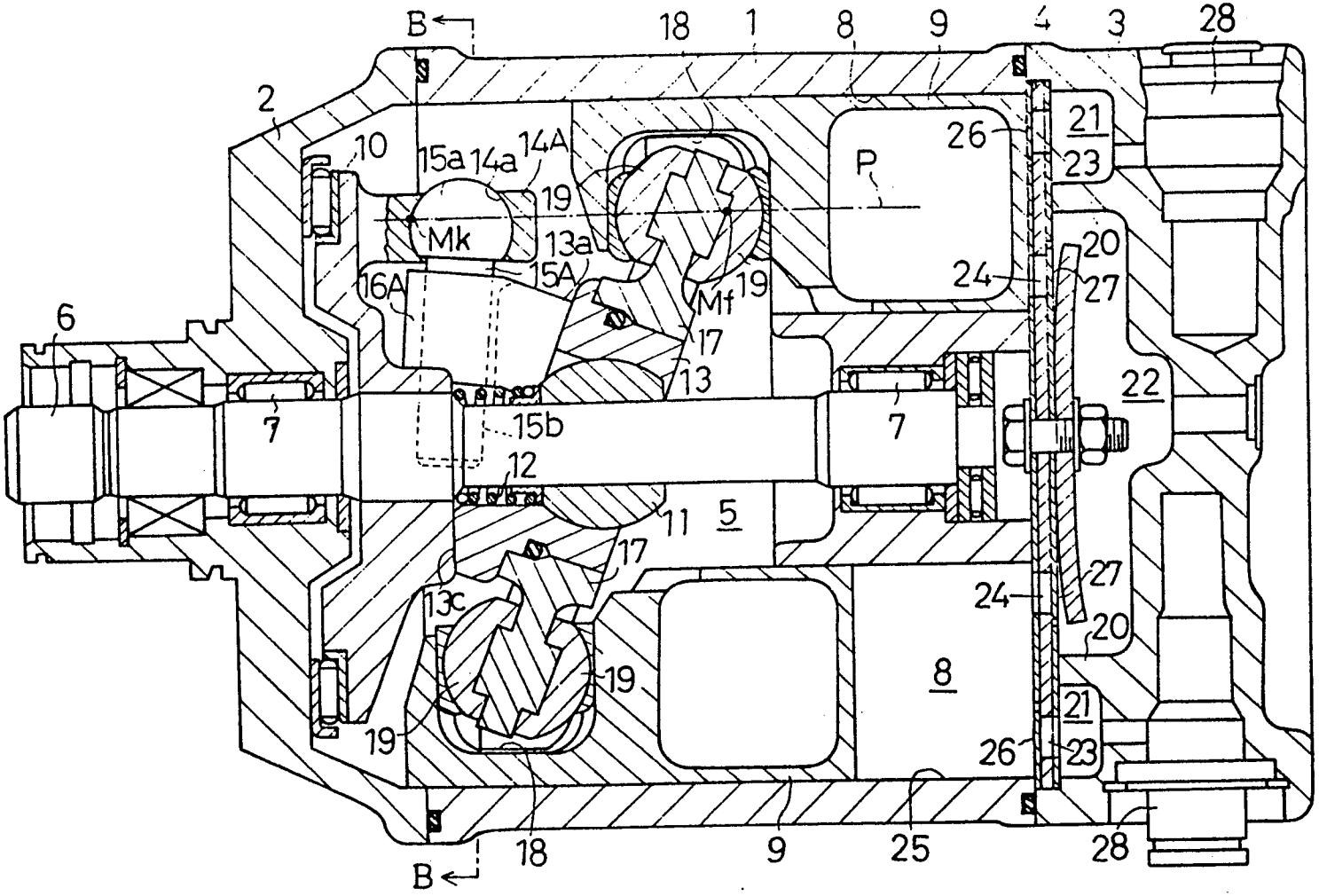
FIG. 1 is a cross-sectional side view of a swash plate type compressor according to the present invention.

As shown in FIG. 1, a front housing 2 is connected to the front end (left side) of a cylinder block 1, and a rear housing 3 is connected to the other end (right side) of the cylinder block 1, with a valve plate 4 interposed therebetween. A drive shaft 6 is accommodated in a crank chamber 5 defined by the cylinder block 1 and the front housing 2. The drive shaft 6 is rotatably supported by a pair of radial bearings 7. The cylinder block 1 has a plurality of cylinder bores 8 arranged around the drive shaft 6. A piston 9 is slidable fitted in each cylinder bore 8. The axis of each piston 9 is adapted to be parallel with that of the drive shaft 6.

A drive plate 10 is supported on the drive shaft 6 in the crank chamber 5, in such a way that it can be rotated integrally with the drive shaft 6. Further, a spherical sleeve 11 is rotatably and slidable fitted around the drive shaft 6. A compression spring 12 is interposed between the drive plate 10 and the spherical sleeve 11, for urging the spherical sleeve 11 toward the rear housing 3.

Figure 2:
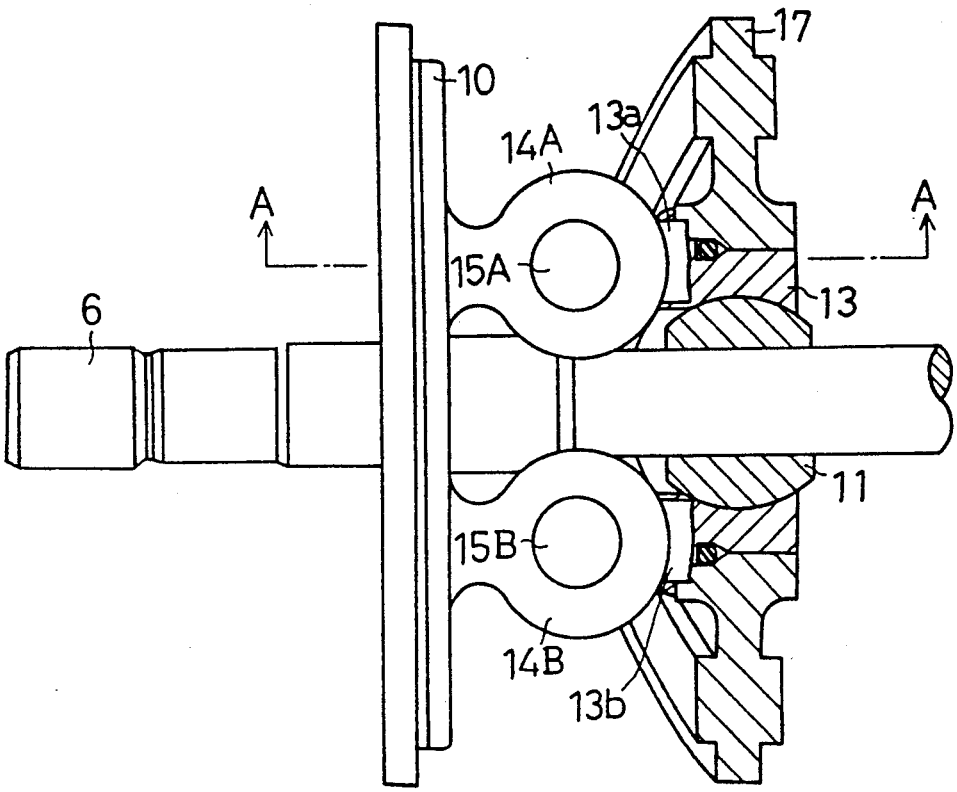
FIG. 2 is an enlarged broken away, partial view showing the elements around a drive plate for use in the compressor of FIG. 1.

A rotary journal 13 is supported on the spherical sleeve 11 in such a way that it can be rocked forward and backward. The rotary journal 13 has an annular shape, and surrounds the rotary shaft 6. As shown in FIGS. 1 and 2, the rotary journal 13 has a pair of brackets 13*a* and 13*b* protruding on each side of the drive shaft 6, from the upper side face thereof opposite to the front housing 2. The drive plate 10 has a pair of support arms 14A and 14B which protrude in an opposite relation with respect to the corresponding brackets 13*a* and 13*b*.

Figure 3:
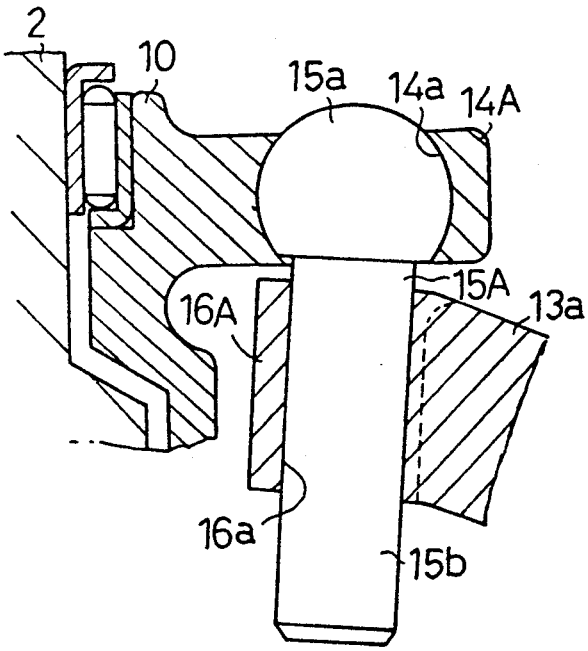
FIG. 3 is a cross-sectional view taken along line A—A in FIG. 2.
Figure 4:
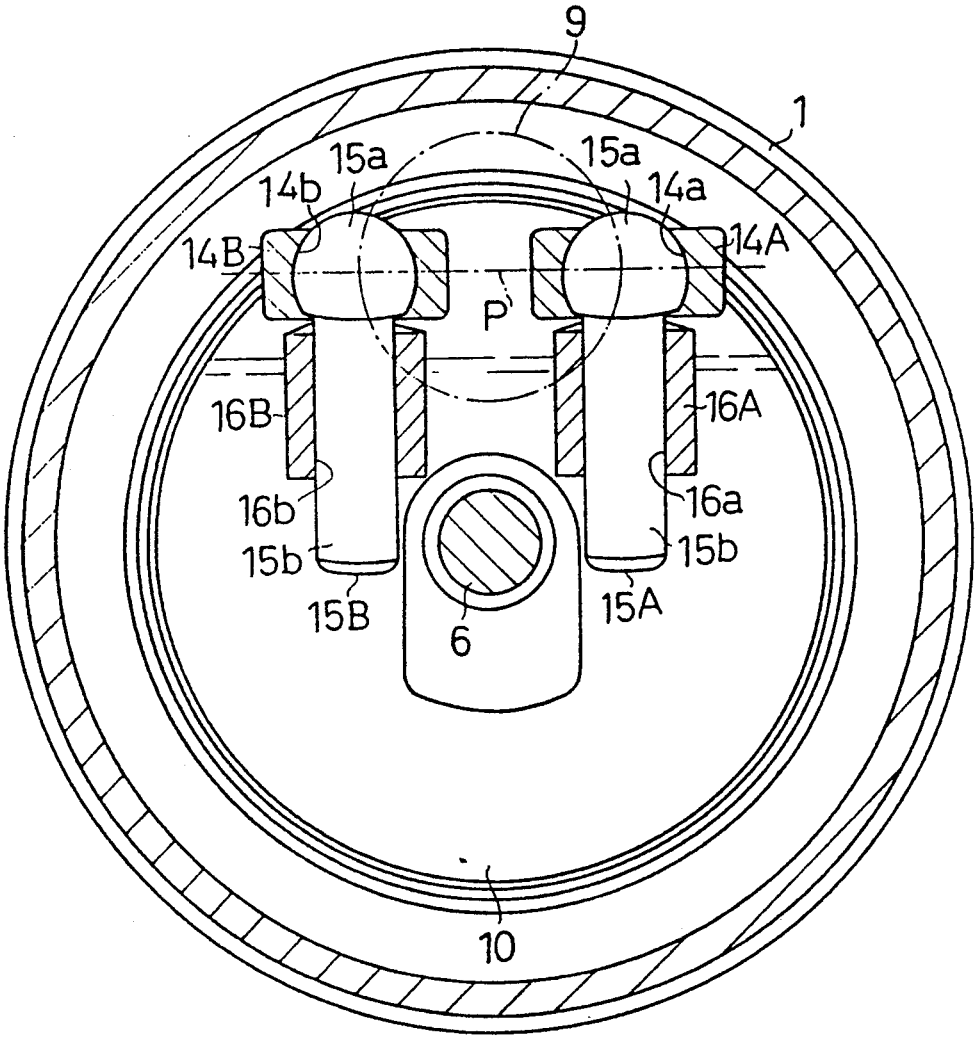
FIG. 4 is a cross-sectional view taken along line B—B in FIG. 1.

As shown in FIGS. 2 to 4, the compressor has a pair of guide pins 15A and 15B, each of which includes a ball portion 15*a* and a rod portion 15*b*. A spherical opening 14*a* (14*b*) is defined at the free end portion of each support arm 14A (14B), in which the ball portion 15*a* of the guide pin 15A (15B) is retained. The engagement of the ball portion with the spherical opening allows the guide pin 15A (15B) to be securely coupled with the support arm 14A (14B), but pivotally with respect to the support arm 14A (14B).

Bosses 16A and 16B include guide holes 16*a* and 16*b* formed at the free end portions of the brackets 13*a* and 13*b*, respectively. The rod portions 15*b* of the guide pins 15A and 15B are slidable inserted into the guide holes 16*a* and 16*b* of the bosses 16A and 16B, respectively. As the spherical sleeve 11 slides on the drive shaft 6 and the rotary journal 13 rocks, the guide pins 15A and 15B pivot on the ball portion 15*a* while they slide along the guide holes 16*a* and 16*b*, respectively. Accordingly, the rotary journal 13 is coupled with the drive plate 10 by the guide pins 15A and 15B, in such a way that the rotary journal 13 may be rotated synchronously with the drive plate 10, regardless of the position of the spherical sleeve 11 or the inclination angle of the rotary journal 13.

When the compression spring 12 has been compressed to the maximum level, as shown in FIG. 1, the contact surface 13*c*, i.e. the lower side face opposite to the front housing 2 of the rotary journal 13, is abutted against the drive plate 10, whereby the rotary journal 13 is prevented from tilting any further.

As shown in FIG. 1, a swash plate 17 is mounted on the circumference of the rotary journal 13. A recess 18 is formed at the tail end portion of the piston 9 fitted in each cylinder bore 8. The peripheral portion of the swash plate 17 is retained via a pair of shoes 19 within the recess 18. Accordingly, the rotational motion of the drive shaft 6 is transmitted to the swash plate 17 through the drive plate 10, guide pins 15A and 15B and rotary journal 13. The rotational motion of the tilted swash plate 17 eventually generates an undulating movement, to cause the reciprocal motion of each piston 9.

The inside of the rear housing 3 is divided into an inlet chamber 21 and a discharge chamber 22 by a cylindrical partition 20. The valve plate 4 has a plurality of inlet ports 23 and a plurality of discharge ports 24 formed for the respective cylinder bores 8. Compression chambers 25 are defined between the valve plate 4 and the respective pistons 9. Each compression chamber 25 communicates with the inlet chamber 21 or the discharge chamber 22, through the corresponding inlet ports 23 or outlet ports 24, respectively. Each inlet port 23 and each outlet port 24 is blocked by an inlet valve 26 and a discharge valve 27, respectively. These valves open or close the inlet ports 23 and discharge ports 24 depending on the difference between the pressures on the both sides of each valve to be caused by the reciprocal motion of the pistons 9. Incidentally, a volume controlling valve mechanism 28 of a known structure for controlling the pressure in the crank chamber 5 is provided in the rear housing 3. The function of the compressor according to the present embodiment will now be described below.

A refrigerant gas which is sucked from the inlet chamber 21 into the respective compression chambers 25, by the reciprocal motion of the pistons 9, is compressed therein, and is discharged to the discharge chamber 22. In this process, the pressure exerted on the head end face of each piston 9, in the cylinder bore 8, fluctuates between the suction pressure and the discharge pressure in accordance with the sucking and discharging (compression) motion of each piston 9.

A force corresponding to the difference between the pressure exerted on the head end face of each piston 9 and the pressure in the crank chamber 5 exerted on the tail end face of the piston 9, is transmitted to the swash plate 17 via the respective shoes 19. The resultant force exerted on the swash plate 17 by each piston 9 produces a moment which causes the swash plate 17 to rotate clockwise or counterclockwise on the spherical sleeve 11. This moment causes a change in the inclination angle of the swash plate 17 and thus regulates the piston stroke.

With the change in the inclination angle of the swash plate 17 based on the difference between the internal pressure of the crank chamber 5 and the suction pressure, the guide pins 15A and 15B slide along the guide holes 16*a* and 16*b*, while they perform a pivotal motion with respect to the drive plate 10. Simultaneously, the rotary journal 13 is tilted, and it slides on the drive shaft 6 together with the spherical sleeve 11, so that the distance between the valve plate 4 and the point (the top of the swash plate in FIG. 1) on the swash plate 17 closest to the valve plate 4 may remain substantially constant. As a result, the top clearance of each piston 9 is maintained substantially constant, regardless of the inclination angle of the swash plate 17.

In the present embodiment, the guide pins 15A and 15B are pivotally supported by the respective support arms 14A and 14B formed integrally with the drive plate 10. Accordingly, the point of support Mk (only the point of support Mk corresponding to the guide pin 15A is shown in FIG. 1) of the compressive stress at the spherical opening 14*a* does not shift even if the inclination angle of the swash plate 17 changes.

Accordingly, the compressor can be designed so that the point of action Mf of the compressive stress on the swash plate 17, corresponding to the piston 9 and located at the top center position, and the points of support Mk (there are two points Mk corresponding to the guide pins 15A and 15B) may be on the same hypothetical horizontal plane P containing the axis of said piston 9, as shown in FIG. 1. In other words, the compressor can now be designed such that the center or midpoint of the line between the point of support Mk (corresponding to the guide pin 15A) and the other point of support (corresponding to the guide pin 15B), may be on the extension of the axis of the piston 9.

Such design can inhibit a rotational moment to be exerted on the swash plate 17, based on the compressive stress from the piston 9 located at the top center position. Therefore, the swash plate 17 can be smoothly tilted to a greater or smaller angle. As a result, the discharge volume controllability can be improved. The compressor according to this embodiment exhibits a well-balanced controllability for increasing or decreasing the discharge volume.

The applicant have previously filed U.S. patent application No. 07/780,140 (corresponding to Japanese Patent Application No. 2-286675). The applications disclose a variable displacement compressor having a bearing with a guide hole that is supported rotatably on a drive plate and a straight rod-shaped guide pin mounted on a rotary journal, wherein the guide pin is inserted into the guide hole of the bearing, to constitute a hinge mechanism for coupling the drive plate and the rotary journal.

In the compressor having such hinge mechanism, the guide pin slides in the radial direction of the compressor along the guide hole, as the inclination angle of the swash plate changes. Since the guide hole is defined in the drive plate, however, the free end portion of the guide pin performs a reciprocal motion in the guide hole, at a position remote from the drive shaft. Such sliding of the guide pin, at a position remote from the drive shaft, causes variation in the load balance of the integrated rotating body, which includes various members attached to the drive shaft, and thus generates vibration of the compressor.

On the other hand, since the guide pins 15A and 15B are pivotally supported at the ball portions 15*a* by the respective support arms 14A and 14B of the drive plate 10, according to the present embodiment, the guide pins 15A and 15B are adapted not to protrude outward from the support arms 14A and 14B. Further, the rod portions 15*b* of the guide pins 15A and 15B slide along the corresponding guide holes 16*a* and 16*b*, at positions close to the drive shaft 6, so that variation in the load balance of the integrated rotating body attached to the drive shaft 6 can be minimized. Accordingly, the drive plate 10, rotary journal 13 and swash plate 17 can be rotated stably, free from vibration.

In the compressor disclosed in U.S. patent application No. 07/780,140, the guide pin is forced to move outward along the guide hole defined in the bearing by the centrifugal force exerted on the guide pin, which eventually urges the swash plate to tilt to a wider angle.

On the other hand, according to the present embodiment, the centrifugal force exerted on the guide pins 15A and 15B is countered by the support arms 14A and 14B, such that the swash plate 17 does not tilt to a certain direction under the centrifugal force. Accordingly, the discharge volume controllability of the compressor does not deteriorate, even if the rotational speed of the drive shaft 6 increases in order to exert a larger centrifugal force on the guide pins 15A and 15B.

The variable displacement compressor having such type of swash plate is frequently used particularly as a compressor in automotive refrigerations unit. The control of the inclination angle of the swash plate, such that the discharge volume decreases as the revolution of the drive shaft increases, is necessary for such a refrigeration unit.

Figure 5:
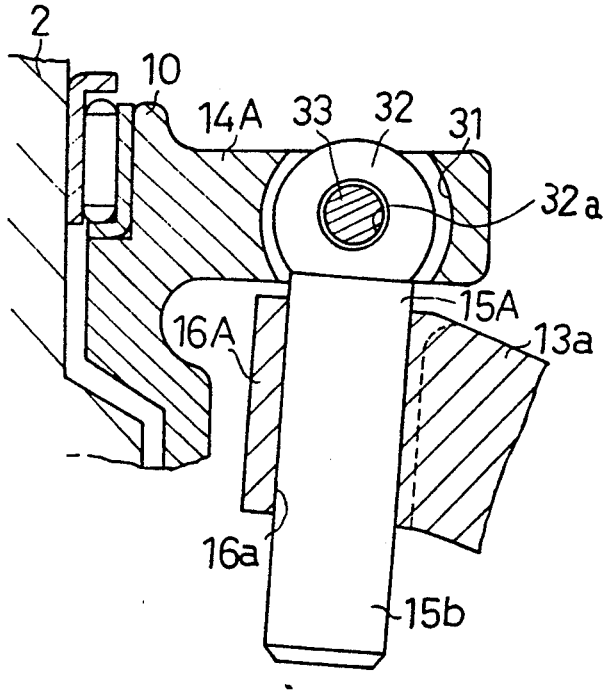
FIG. 5 is a view corresponding to FIG. 3 according to another embodiment of the present invention.
Figure 6:
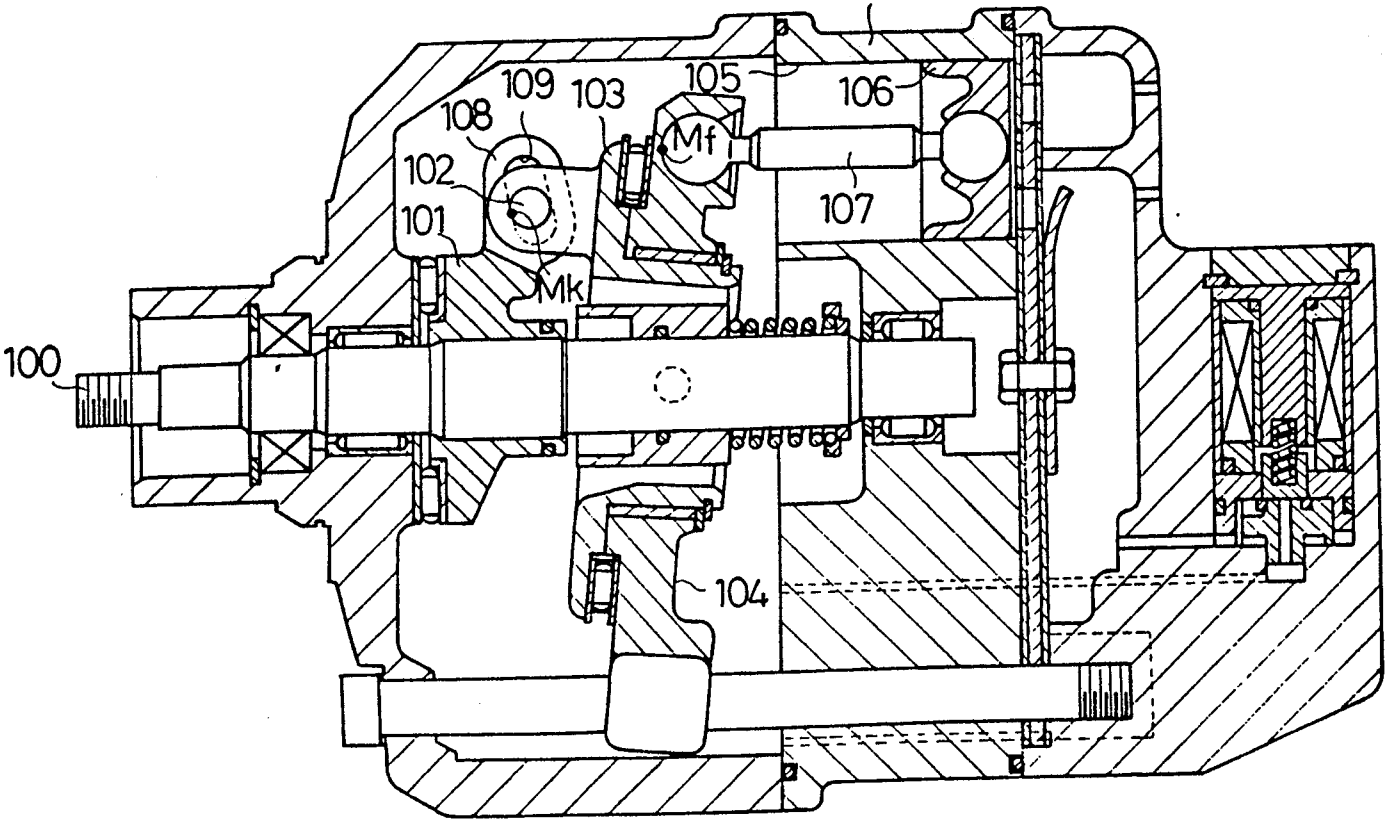
Fig. 6 (PRIOR ART)
FIG. 6 is a cross-sectional view of a prior art swash plate type compressor.

Moreover, since the guide pins 15A and 15B are adapted not to protrude outward from the support arms 14A and 14B, the support arms 14A and 14B can be provided on the drive plate 10 at positions close to the inner wall surface of the cylinder block 1, as shown in FIG. 4. Such design permit the reduction of the shell diameter of the compressor. Although only one embodiment of the present invention has been described herein, it should be apparent to those skilled in the art that the present invention may be embodied in many other specific forms without departing from the scope of the invention. Particularly, it should be understood that the coupling structure shown in FIG. 5 could also be employed. To describe the coupling structure more specifically referring to only one guide pin 15A, a slit 31 is defined at the free end portion of the support arm 14A of the drive plate 10. A pivot 33 is adapted to be fitted within the opening 31. A disc-shaped supporting portion 32 having a hole 32*a* is formed at the head of the guide pin 15A. Thus, the guide pin 15A is supported at the disc-shaped supporting portion 32 in the slit 31 by the pivot 33, so as to be able to swing forward and backward.

It is also possible to connect the swash plate 17 with the respective pistons 9 by connecting rods instead of connecting them using shoes 19.

Therefore, the present examples and embodiments are to be considered as illustrative and not restrictive, and the invention is not to be limited to the details given herein.

What is claimed is:

1. A variable displacement compressor comprising:

a housing including a crank chamber and a cylinder block having a plurality of cylinders;

a plurality of pistons disposed in respective ones of said cylinders;

a drive shaft rotatably mounted in said housing;

a drive plate mounted on said drive shaft for rotating integrally with said drive shaft;

a supporting member mounted on said drive shaft for axial movement along said shaft;

a rotary journal pivotally mounted on said supporting member and pivotally coupled with said drive plate for rotating synchronously with said drive plate, said rotary journal being movable along said drive shaft together with said supporting member;

a swash plate, supported on said rotary journal, for driving said pistons in a reciprocal motion for compressing a fluid, the inclination angle of said swash plate being controlled in relation to the pressure in each of said cylinders and the internal pressure of the crank chamber; and pin means, mounted pivotally on said drive plate, for coupling said drive plate with said rotary journal, said pin means being adapted to slide with respect to said rotary journal, and to pivot with respect to said drive plate, when said rotary journal pivots with respect to said drive plate while said rotary journal together with said supporting member slide along said drive shaft.

2. The compressor according to claim 1, wherein said rotary journal has a guide hole for receiving said pin means slidable therein.

3. The compressor according to claim 1, wherein said pin means includes at least one guide pin having a ball portion and a rod portion.

4. The compressor according to claim 3, wherein said drive plate has a spherical opening for receiving therein said ball portion of said guide pin.

5. The compressor according to claim 1, wherein said pin means includes at least one guide pin having a rod portion, and a pivot for pivotally connecting said guide pin to said drive plate.

6. The compressor according to claim 1, wherein said pin means is adapted in such a way that a point Mk, where the load generated by the pressure on a selected piston is transmitted to said drive plate, via said swash plate and said pin means, may not substantially be shifted regardless of the inclination angle of said swash plate.

7. The compressor according to claim 1, wherein said pin means is adapted in such a way that an imaginary plane containing a point Mf, where the load generated by the pressure exerted on a selected piston is transmitted to said swash plate, and a point Mk, where the load transmitted to said swash plate is transmitted via said pin means to said drive plate, may be substantially parallel to the rotational axis of said drive shaft.

8. The compressor according to claim 1, wherein said pin means includes a pair of guide pins disposed on each side of said drive shaft.

9. The compressor according to claim 8, wherein said guide pins are arranged in such a way that the center of a line joining two points Mk, where said guide pins transmit the load exerted thereto from said swash plate to said drive plate, is located on the extension of the axis of a selected piston located at the top center position.

10. The compressor according to claim 1, wherein said supporting member is a spherical sleeve which is slidable on said drive shaft.

11. The compressor according to claim 1 further comprising a plurality of shoes that slidably receive said swash plate, for connecting said pistons to said swash plate.

12. A variable displacement compressor comprising:

a housing including a crank chamber and a cylinder block having a plurality of cylinders;

a plurality of pistons disposed in respective ones of said cylinders;

a drive shaft rotatably mounted in said housing;

a drive plate mounted on said drive shaft for rotating integrally with said drive shaft;

a rotary journal pivotally coupled with said drive plate for rotating synchronously with said drive plate, said rotary journal being slidable along said drive shaft;

a swash plate, supported on said rotary journal, for driving said pistons in a reciprocal motion for compressing a fluid, wherein the inclination angle of said swash plate is controlled in relation to the pressure in each of said cylinders and the internal pressure of the crank chamber; and at least one pin means, mounted pivotally on said drive plate, for coupling said drive plate and said rotary journal, said pin means having a ball portion and a rod portion;

said drive plate having at least one spherical opening for retaining therein said ball portion of said pin means; and said drive journal having at least one guide hole for retaining the rod portion of said pin means, said pin means sliding along said guide hole when said rotary journal pivots with respect to said drive plate;

whereby said pin means is adapted in such a way that points Mk, where the load generated by the pressure on a selected piston is transmitted to said drive plate, is not substantially shifted regardless of the inclination angle of said swash plate.

13. The compressor according to claim 12 further comprising a plurality of shoes that slidable receive said swash plate, for connecting said pistons and said swash plate.

14. The compressor according to claim 12, wherein said pin means are adapted in such a way that an imaginary plane containing a point Mf, where the load generated by the pressure exerted on a selected piston is transmitted to said swash plate, and points Mk, where the load transmitted to said swash plate is transmitted via said pin means to said drive plate, may be substantially parallel with to rotational axis of said drive shaft.

15. The compressor according to claim 12, wherein said pin means includes a pair of guide pins disposed on each side of said drive shaft.

16. The compressor according to claim 15, wherein said guide pins are arranged in such a way that the center of a line joining two points Mk, where said guide pins transmit the load from said swash plate to said drive plate, is located on the extension of the axis of a selected piston located at the top center position.

17. The compressor according to claim 12 further comprising a spherical sleeve which pivotally supports said rotary journal with respect to said drive plate, and which is slidable on said drive shaft.

18. A variable displacement compressor comprising:

a housing including a crank chamber and a cylinder block having a plurality of cylinders;

a plurality of pistons disposed in respective ones of said cylinders;

a drive shaft rotatably mounted in said housing;

a drive plate mounted on said drive shaft for rotating integrally with said drive shaft;

a rotary journal coupled to said drive plate for rotation synchronously with and driven by said drive plate, said journal being mounted on said drive shaft for pivotal movement to variable inclination angles relative to said drive shaft accompanied by movement axially along said drive shaft;

a swash plate, supported on said rotary journal, for driving said pistons in a reciprocal motion for compressing a fluid, wherein the inclination angle of said swash plate is controlled in relation to the pressure in each of said cylinders and the internal pressure of the crank chamber; and pin means, mounted pivotally on said drive plate, for coupling said drive plate with said rotary journal, said pin means being adapted to slide with respect to said rotary journal, and to pivot with respect to said drive plate, when said rotary journal pivots with respect to said drive plate;

whereby the top dead center clearance of said pistons in said cylinders is maintained substantially constant for all of said inclination angles of said swash plate.

* * * * *

UNITED STATES PATENT AND TRADEMARK OFFICE

CERTIFICATE OF CORRECTION

PATENT NO. : 5,293,810

DATED : March 15, 1994

INVENTOR(S) : Kimura et al

It is certified that error appears in the above-indentified patent and that said Letters Patent is hereby corrected as shown below:

Column 1, line 29, after "a" and before "piston 106" insert --drive shaft 100. A swash plate 104 is supported by the rotary journal 103. A plurality of cylinders 105 are provided in a cylinder block 110. Each cylinder receives a--.

Signed and Sealed this

Eleventh Day of October, 1994

*Attest:*

*Attesting Officer*

BRUCE LEHMAN

*Commissioner of Patents and Trademarks*